US010388193B1

(12) United States Patent
Wriedt

(10) Patent No.: US 10,388,193 B1
(45) Date of Patent: Aug. 20, 2019

(54) FURNITURE HAVING INTERCHANGEABLE ADVERTISING PANELS

(71) Applicant: BLUE HIPPO, LLC, Orlando, FL (US)

(72) Inventor: Bradley E. Wriedt, Windermere, FL (US)

(73) Assignee: BLUE HIPPO, LLC, Orlando, FL (US)

( * ) Notice: Subject to any disclaimer, the term of this patent is extended or adjusted under 35 U.S.C. 154(b) by 0 days.

(21) Appl. No.: 16/281,497

(22) Filed: Feb. 21, 2019

Related U.S. Application Data

(60) Provisional application No. 62/636,387, filed on Feb. 28, 2018.

(51) Int. Cl.

| | |
|---|---|
| ***G09F 7/04*** | (2006.01) |
| ***G09F 23/08*** | (2006.01) |
| ***A47B 96/20*** | (2006.01) |
| ***G09F 23/06*** | (2006.01) |
| *A47C 7/62* | (2006.01) |

(52) U.S. Cl.
CPC ..... *G09F 7/04* (2013.01); *A47B 96/20* (2013.01); *G09F 23/06* (2013.01); *G09F 23/08* (2013.01); *A47B 2096/209* (2013.01); *A47C 7/62* (2013.01)

(58) Field of Classification Search
CPC . G09F 7/04; G09F 23/06; G09F 23/08; A47B 96/20; A47B 2096/209; A47C 7/62
See application file for complete search history.

(56) References Cited

U.S. PATENT DOCUMENTS

| | | | | | |
|---|---|---|---|---|---|
| 4,040,194 | A * | 8/1977 | Penton | G09F 7/04 | 40/606.18 |
| 5,167,087 | A * | 12/1992 | Plumly | G09F 7/04 | 40/600 |
| 5,269,083 | A * | 12/1993 | Vampatella | A47G 1/065 | 248/206.5 |
| 5,303,493 | A * | 4/1994 | Plumly | G09F 7/04 | 40/600 |
| 5,342,109 | A * | 8/1994 | Berry | B63C 9/28 | 297/188.03 |
| 5,600,911 | A * | 2/1997 | Lucci | A47G 11/004 | 108/25 |
| 6,347,469 | B1 * | 2/2002 | Huellinghoff | G09F 7/04 | 40/600 |

(Continued)

*Primary Examiner* — Gary C Hoge
(74) *Attorney, Agent, or Firm* — Matthew G. McKinney, Esq.; Allen, Dyer, Doppelt+Gilchrist, PA

(57) ABSTRACT

Furniture for displaying advertising includes a table having a planar surface, a steel plate secured to the planar surface and having a first polarity, and an advertising panel comprised of a flexible material and having a second polarity. The advertising panel is removably secured to the steel plate using magnetic forces. A protruding lip extends about a periphery of the planar surface and around the advertising panel so that a top surface of the advertising panel is flush with a top surface of the protruding lip. A vertical support has a first end secured to a lower portion of the planar surface and an opposing second end configured to be placed on a ground surface. The planar surface of the table is substantially perpendicular relative to a longitudinal axis of the vertical support causing the advertising panel to be horizontal to the ground surface.

8 Claims, 5 Drawing Sheets

(56) References Cited

U.S. PATENT DOCUMENTS

| | | | | |
|---|---|---|---|---|
| 8,182,031 | B1 * | 5/2012 | MacKenzie | A47B 3/08 108/125 |
| 9,390,571 | B1 * | 7/2016 | Kupfer | A47C 7/72 |
| 2001/0008702 | A1 * | 7/2001 | Vela | A47G 23/0303 428/542.2 |
| 2005/0155529 | A1 * | 7/2005 | Wunsh | A47B 13/12 108/90 |
| 2005/0284009 | A1 * | 12/2005 | Lazarus | G09F 23/06 40/358 |
| 2005/0284011 | A1 * | 12/2005 | Todd | G09F 7/04 40/600 |
| 2008/0006182 | A1 * | 1/2008 | Mason | A47B 13/12 108/25 |
| 2008/0209776 | A1 * | 9/2008 | Suprina | G09F 7/06 40/1 |
| 2009/0123344 | A1 * | 5/2009 | Dobler | A61L 9/048 422/123 |
| 2009/0276319 | A1 * | 11/2009 | Lungu | G06Q 30/02 705/14.73 |
| 2011/0192064 | A1 * | 8/2011 | Bowman | G09F 7/04 40/600 |
| 2012/0060398 | A1 * | 3/2012 | Bowman | G09F 7/04 40/600 |
| 2012/0097078 | A1 * | 4/2012 | Schwabe | A47B 13/08 108/90 |
| 2012/0175926 | A1 * | 7/2012 | McKinney | A47C 31/11 297/220 |
| 2014/0310941 | A1 * | 10/2014 | Anderson | F21V 33/0012 29/458 |
| 2015/0104779 | A1 * | 4/2015 | Kingston | B43L 1/008 434/409 |
| 2015/0157126 | A1 * | 6/2015 | Wang | A47B 95/04 297/188.04 |

* cited by examiner

FURNITURE HAVING INTERCHANGEABLE ADVERTISING PANELS

CROSS-REFERENCE TO RELATED APPLICATIONS

This application claims priority to U.S. Provisional Application Ser. No. 62/636,387 filed on Feb. 28, 2018, the contents of which are herein incorporated by reference in their entirety.

TECHNICAL FIELD

The present invention relates to the field of furniture, and, more particularly, to furniture having interchangeable advertising panels.

BACKGROUND

Tables and chairs are widely used in restaurants, hotel pool decks, lounges, and other similar commercial locations. Accordingly, many people pass through these areas every day, providing a unique opportunity to display advertising.

Often times free-standing carriers may be placed on the tables in order to display various advertisements. The advertisements are designed to attract the attention of the customer while being served and therefore provide a valuable advertising opportunity. However, the advertising space is limited on a table top and the advertisements may become loose and blow away or be damaged. Thus, there is a need in the art for a device that increases the visibility of advertising on furniture.

SUMMARY

In view of the foregoing background, it is therefore an object of the present invention to provide furniture, such as a table, for displaying advertising. In a particular aspect, the furniture comprises a planar surface defined on the furniture for displaying the advertising, a plate secured to the planar surface and inset therein, and an advertising panel removably secured over the plate using magnetic forces and having similar dimensions and a shape to the planar surface defined on the furniture. In addition, a protruding lip extends about a periphery of the planar surface and around the advertising panel.

The plate may be comprised of steel and have a first polarity. The furniture comprises a table having a first end of a vertical support secured to a lower portion of the planar surface and an opposing second end configured to be placed on a ground surface. The planar surface is substantially perpendicular relative to a longitudinal axis of the vertical support causing the advertising panel to be horizontal to the ground surface.

In another aspect, the furniture comprises a chair having armrests with each of the armrests having the plate inset therein. The chair may also have a backrest with the plate inset therein. The planar surface may be comprised of recycled HDPE plastic, and the advertising panel is comprised of a flexible material and can be peeled off the plate. The advertising panel may comprise a laminated vinyl layer having indicia and an underlying magnetic layer.

In another aspect, a method of displaying advertising on furniture comprising a planar surface, a plate secured to the planar surface, and a protruding lip extending about a periphery of the planar surface is disclosed. The method includes removably securing an advertising panel over the plate using magnetic forces, where the advertising panel comprises a laminated vinyl layer having indicia and an underlying magnetic layer.

DETAILED DESCRIPTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art.

Figure 1:
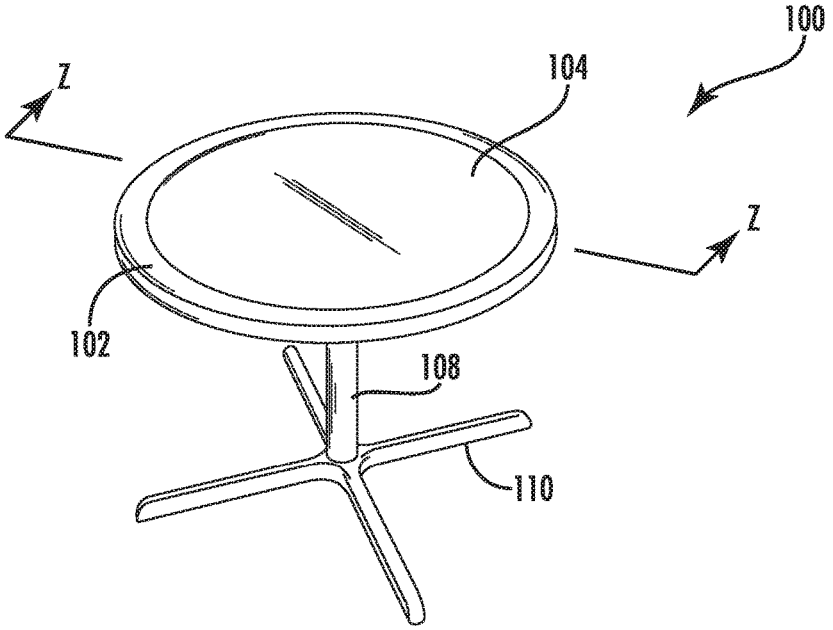
FIG. 1 is a perspective view of a table having an interchangeable advertising panel in accordance with a particular aspect of the invention.

Referring now to FIG. 1, a particular illustrative embodiment of furniture having interchangeable advertising panels in accordance with the disclosure is shown. As can be appreciated by those of ordinary skill in the art, the furniture may be any piece of furniture including, but not limited to, tables, chairs, benches, desks, countertops, etc. In particular, tables and chairs are widely used in restaurants, hotel pool decks, lounges, and other similar commercial locations. Accordingly, many people pass through these areas every day, providing a unique opportunity to display advertising. However, the advertising space is limited on a table top, for example, and the advertisements may become loose and blow away or be damaged. Thus, the furniture shown in FIGS. 1-9 and described hereinafter increases the visibility and efficacy of the advertising.

In accordance with a particular aspect of the invention, a table 100 includes a planar surface 102 (i.e., table top) that is configured to receive a removable and interchangeable advertising panel 104. The advertising panel 104 may generally have similar dimensions and a shape to the planar surface 102 of the table 100.

A periphery of a top side of the planar surface 102 has a protruding lip 112 that extends around the advertising panel 104. Accordingly, the protruding lip 112 serves to provide a border and to accentuate the advertising panel 104. A top surface of the advertising panel 104 is flush with a top surface of the protruding lip 112 to provide a smooth transition across the planar surface (i.e., table top). The advertising panel 104 may have decorative graphics displayed thereon.

The table 100 may also include a vertical support 108 extending from a lower portion of the planar surface 102. A first end of the vertical support 108 is secured to the lower portion of the planar surface 102. The vertical support 108 has an opposing second end that may be secured to a plurality of feet 110 that extend away from the second end of the vertical support 108 and be placed on a ground surface. Those of ordinary skill in the art will appreciate that the vertical support 108 may be supported in a vertical orientation relative to the ground surface in a number of different ways. The planar surface 102 is substantially perpendicular relative to a longitudinal axis of the vertical support 108 causing the advertising panel 104 to be horizontal to the ground surface.

Figure 2:
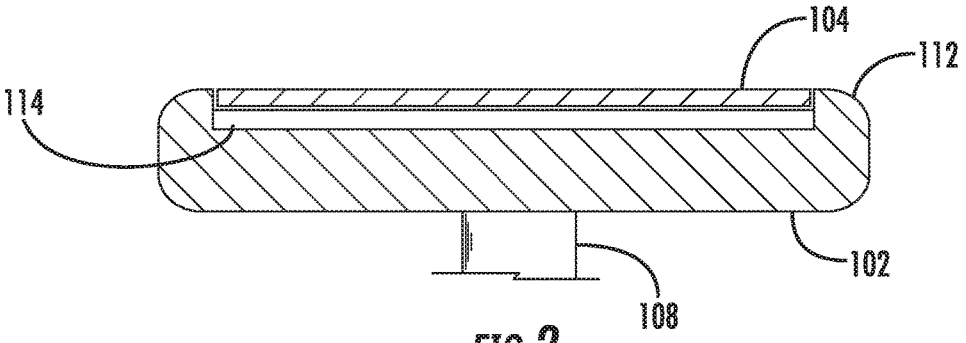
FIG. 2 is a cross sectional view taken in the direction of line 2-2 of FIG. 1.

A cross sectional view of a portion of the table 100 is shown in FIG. 2. In a particular aspect, the planar surface 102 is horizontal relative to a longitudinal axis of the vertical supports 108. Thus, when the table 100 is in use, the advertising panel 104 can be read by a customer looking down at the top of the table 100. This makes the advertising panel 104 easier to view in its entirety even when the customer may be standing next to the table 100.

The advertising panel 104 is magnetic with a first polarity and is configured to removably adhere to a plate 114 having a second polarity. The plate 114 may be magnetic and be integrated within the planar surface 102 and screwed to the planar surface 102 or otherwise secured thereto. In a particular embodiment, the plate 114 has a thickness of 0.1345 (10*ga*) and comprised of steel that is painted to match the planar surface 102. The planar surface 102 may be comprised of HDPE plastic, wood, or any other material suitable for commercial furniture.

Figure 3:
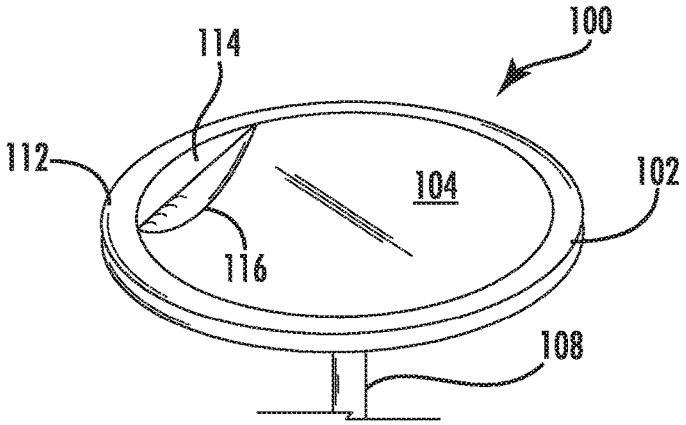
FIG. 3 is a perspective view of the table with an interchangeable advertising panel being partially removed.

The advertising panel 104 is comprised of a flexible material and can be peeled off the plate 114 by grasping an edge 116 and pulling as illustrated in FIG. 3. Another advertising panel 104 can then be placed back on the plate 114 to display the desired graphics printed thereon for a change.

The advertising panel 104 may be reversible so that a side that is facing outwards and exposed to the weather can be reversed so that the opposing second side can then be displayed. In some cases both sides may have identical graphics so that when one side is worn, the other can be displayed. Alternatively, the opposing sides may have different graphics.

Figure 4:
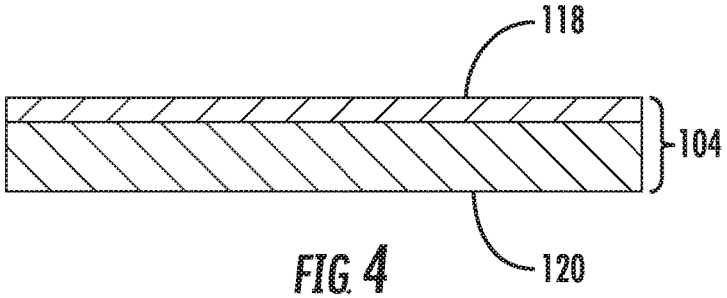
FIG. 4 is a cross sectional view of the interchangeable advertising panel.

A cross section of the advertising panel 104 is shown in FIG. 4. The advertising panel 104 is comprised of a flexible material. In a particular embodiment, the advertising panel 104 has a laminated vinyl layer 118 and an underlying magnetic layer 120 having a second polarity. The vinyl layer 118 and the magnetic layer 120 have similar size, shape, and dimensions. In a particular aspect, the magnetic layer 120 has a thickness of about 0.03 inches, and the vinyl layer 118 has a thickness of about 0.045 inches.

Figure 5:
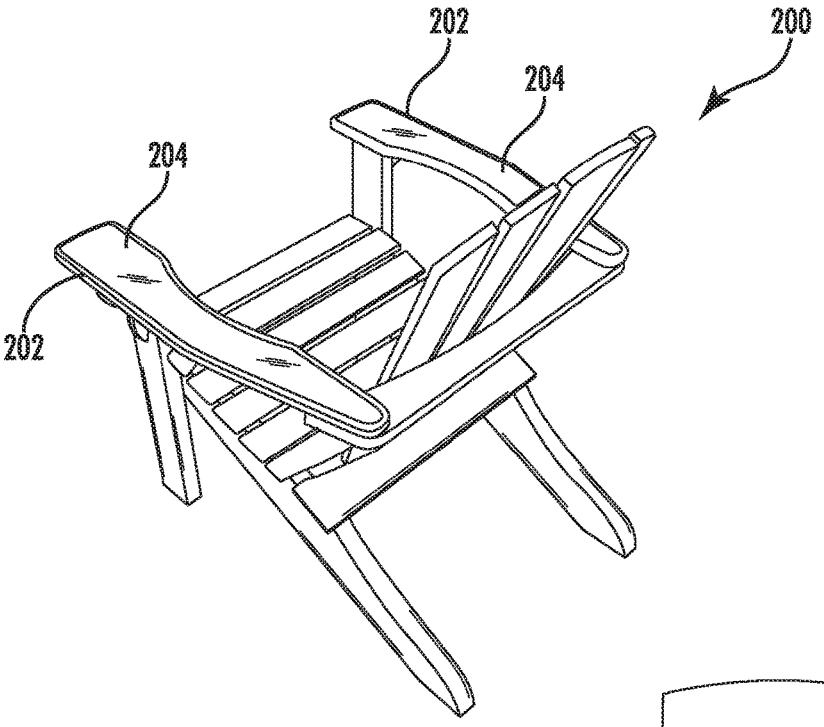
FIG. 5 is a perspective view of a chair having interchangeable advertising panels located in armrests of the chair in accordance with another aspect of the invention.
Figure 6:
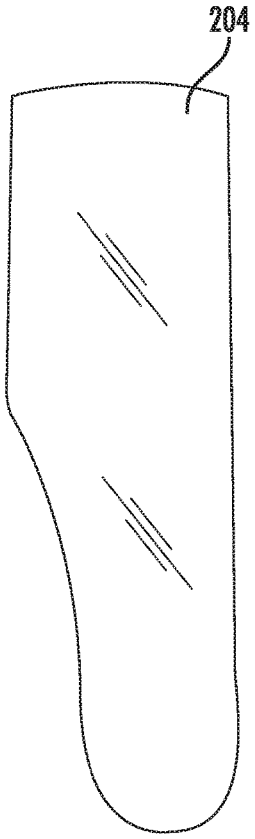
FIG. 6 is a front elevational view of the interchangeable advertising panel of FIG. 5 removed from the armrest.

In another particular aspect of the invention, the furniture comprises a chair 200 having armrests 202 with interchangeable advertising panels 204 as shown in FIGS. 5 and 6. Each of the armrests 202 have a plate inset therein. The advertising panel 204 has a first polarity and the plate has a second polarity so that the advertising panel 204 can be secured with magnetic forces as described above and shown in FIG. 2. The advertising panels 204 may have a similar size and shape to the respective armrests 202.

Figure 7:
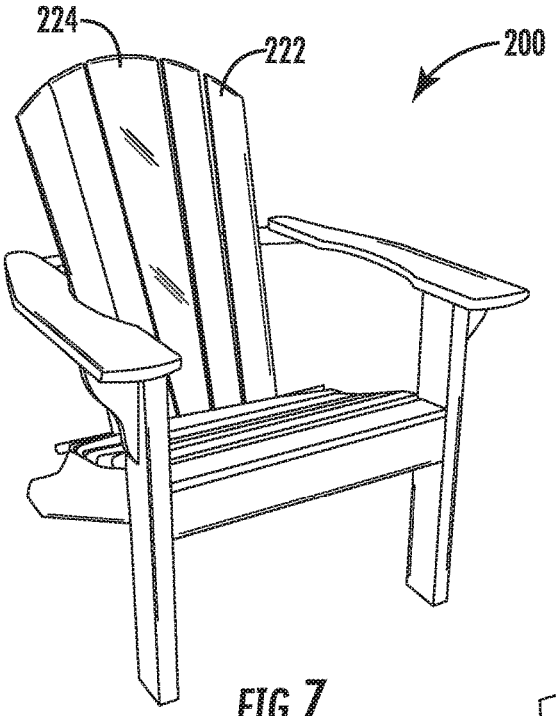
FIG. 7 is a perspective view of the chair having an interchangeable advertising panel located in a back of the chair.
Figure 8:
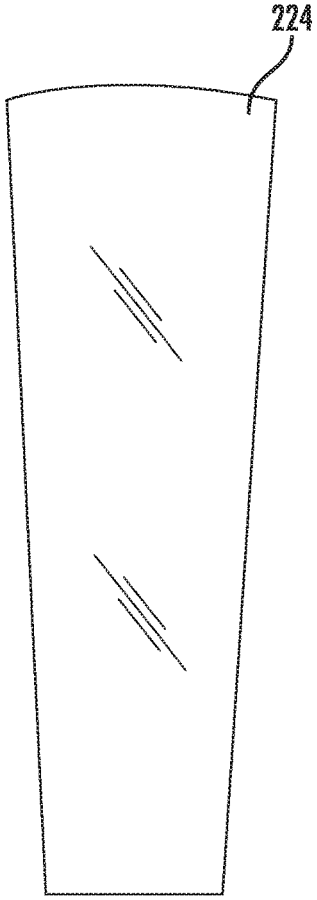
FIG. 8 is a front elevational view of the interchangeable advertising panel of FIG. 7 removed from the back of the chair.
Figure 9:
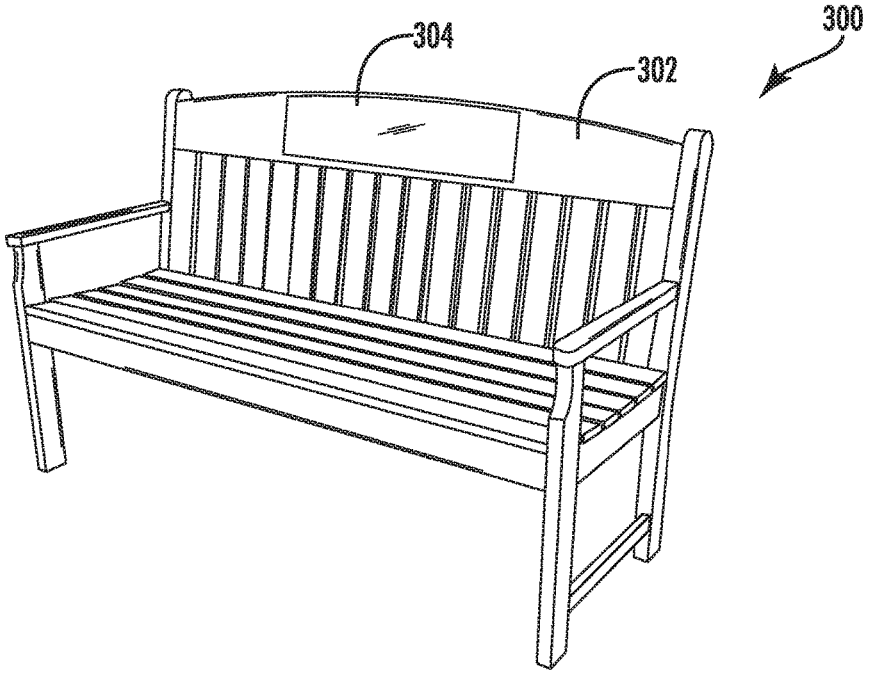
FIG. 9 is a perspective view of a bench having an interchangeable advertising panel located in the back of the bench in accordance with another aspect of the invention.

The chair 200 may also include an advertising panel 224 secured to a back 222 of the chair 200 as shown in FIG. 7. Accordingly, the advertising panel 224 is viewed each time a customer approaches the chair 200 and even when customers are walking past the chair 200. In a particular aspect, the size and shape of the advertising panel 224 is configured to fit on a single slat of the chair 200 as shown in FIG. 8.

In yet another particular aspect, the furniture comprises a bench 300 having an advertising panel 304 secured to the back 302 of the bench 300. In this way, the advertising panel 304 is sized and shaped to fit along an upper support of the back 302. Accordingly, the advertising panel is viewable by customers approaching the bench 300 or simply walking past.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. Furniture for displaying advertising, the furniture comprising:

a planar surface defined on the furniture for displaying the advertising;

a plate secured to the planar surface; and an advertising panel removably secured over the plate using magnetic forces and having similar dimensions and a shape to the planar surface defined on the furniture;

wherein the furniture comprises a table having a first end of a vertical support secured to a lower portion of the planar surface and an opposing second end configured to be placed on a ground surface.

2. The furniture of claim 1, further comprising a protruding lip extending about a periphery of the planar surface and around the advertising panel.

3. The furniture of claim 1, wherein the plate is comprised of steel and has a first polarity.

4. The furniture of claim 1, wherein the planar surface is substantially perpendicular relative to a longitudinal axis of the vertical support causing the advertising panel to be horizontal to the ground surface.

5. The furniture of claim 1, wherein the planar surface is comprised of recycled HDPE plastic.

6. The furniture of claim 1, wherein the advertising panel comprises a laminated vinyl layer having indicia and an underlying magnetic layer.

7. Furniture for displaying advertising, the furniture comprising:

a planar surface defined on the furniture for displaying the advertising;

a plate secured to the planar surface; and an advertising panel removably secured over the plate using magnetic forces and having similar dimensions and a shape to the planar surface defined on the furniture;

wherein the furniture comprises a chair having armrests with at least one of the armrests having the plate inset therein.

8. Furniture for displaying advertising, the furniture comprising:

a planar surface defined on the furniture for displaying the advertising;

a plate secured to the planar surface; and an advertising panel removably secured over the plate using magnetic forces and having similar dimensions and a shape to the planar surface defined on the furniture;

wherein the furniture comprises a chair with a backrest having the plate inset therein.

* * * * *